US006331070B1

(12) United States Patent
Desai

(10) Patent No.: US 6,331,070 B1
(45) Date of Patent: Dec. 18, 2001

(54) PROCESS AND APPARATUS FOR PARTICLE SIZE REDUCTION AND HOMOGENEOUS BLENDING OF INGREDIENTS IN A FLUIDIZED CHANGE CAN MIXER

(75) Inventor: Devendra Dahyabhai Desai, Missouri, TX (US)

(73) Assignee: Reliance Industries, Inc., Missouri City, TX (US)

( * ) Notice: Subject to any disclaimer, the term of this patent is extended or adjusted under 35 U.S.C. 154(b) by 0 days.

(21) Appl. No.: 09/699,602

(22) Filed: Oct. 30, 2000

(51) Int. Cl.[7] ..... B01F 7/16

(52) U.S. Cl. ..... 366/197; 366/199; 366/205; 366/331

(58) Field of Search ..... 366/314, 197, 366/241, 199, 208, 209, 242, 244, 245, 205, 247, 261, 331, 200

(56) References Cited

U.S. PATENT DOCUMENTS

| | | | | |
|---|---|---|---|---|
| 3,137,327 | * | 6/1964 | Muench | 366/220 |
| 3,224,741 | * | 12/1965 | Muench, Sr. | 366/197 |
| 3,746,316 | * | 7/1973 | Langen et al. | 366/213 |
| 4,042,221 | * | 8/1977 | Myers et al. | 366/207 |
| 4,135,828 | * | 1/1979 | Cabak | 366/197 |
| 4,372,686 | * | 2/1983 | Herfeld | 366/220 |
| 4,432,650 | * | 2/1984 | Langen et al. | 366/197 |
| 4,671,666 | * | 6/1987 | Herfeld | 366/197 |
| 4,676,658 | * | 6/1987 | Herfeld | 366/197 |
| 4,698,917 | * | 10/1987 | Debolini | 366/224 |
| 4,781,468 | * | 11/1988 | Herfeld | 366/213 |
| 4,957,373 | * | 9/1990 | Derksen et al. | 366/197 |
| 5,054,933 | * | 10/1991 | Derksen et al. | 366/138 |
| 5,123,747 | * | 6/1992 | Derksen | 366/197 |
| 5,344,275 | * | 9/1994 | Habicht | 414/420 |
| 5,516,207 | * | 5/1996 | Habicht | 366/213 |
| 5,865,538 | * | 2/1999 | Walker et al. | 366/197 |
| 6,196,784 | * | 3/2001 | Karpisek | 414/421 |
| 6,241,380 | * | 6/2001 | Bornemann et al. | 366/217 |

FOREIGN PATENT DOCUMENTS

| | | | |
|---|---|---|---|
| 23 62 675 | * | 6/1975 | (DE) . |
| 35 12 257 | * | 10/1986 | (DE) . |
| 39 30 954-C2 | * | 7/1995 | (DE) . |
| WO 82/ 04407 | * | 12/1982 | (WO) . |

* cited by examiner

*Primary Examiner*—Tony G. Soohoo
(74) *Attorney, Agent, or Firm*—Madan, Mossman & Sriram, P.C.

(57) ABSTRACT

The invention apparatus comprises a mixing vessel closure having rotating mixing blades secured thereto. The mixing blades are driven through an axially engaged and disengaged direct coupling. The closure is mounted on a power base structure for rotation about an axis that is substantially transverse of the mixing blade axis. Additionally, the closure mounting includes a translational drive for linearly raising and lowering the closure at each of two positions about the transverse axis. A portable mixing vessel including a material charge is placed under the vessel closure. The closure is translated down to a sealed cover position over a vessel opening and secured to the vessel. The unitized assembly of the closure and vessel is translated away from a vessel supporting transport base and rotated to a inverted position. The unitized assembly is then translated down to engage a rotatory power transmission coupling. Rotatory power delivered to a fixed axis coupling element is thereby delivered to the mixing blades. At a conclusion of the mixing process, the procedure is reversed and the unitized assembly is rotated and translated back to the supporting transport base. The closure is then released from and translated away from the vessel containing the material mixture thereby leaving the vessel and the mixed material therein free of structural association with the power base.

15 Claims, 5 Drawing Sheets

PROCESS AND APPARATUS FOR PARTICLE SIZE REDUCTION AND HOMOGENEOUS BLENDING OF INGREDIENTS IN A FLUIDIZED CHANGE CAN MIXER

BACKGROUND OF THE INVENTION

1. Field of the Invention

The present invention relates to the machines and material handling methods for homogeneous particle mixing of batch quantities. More particularly, the invention relates to vertical fluidized batch mixers and related batch processes of material handling.

2. Description of the Prior Art

In the production of powder coatings, toners, engineered polymers and color concentrates, ingredient size reduction and homogeneous blending are primary objectives. Also important are the prevention of ingredient resegregation, equipment cleanability and product transfer mobility. For high value products that require extreme constituent control, vertical shaft batch mixers are the tool of choice for most practitioners.

Many processes thrive on high intensity mixing which, definitively, requires a mixing blade tip speed of greater than 20 m/sec. The mixer blade tip velocity for medium intensity mixers is usually defined as within the range of 8–10 m/sec. Driving mixing blades through a large quantity of powdered solids at such blade tip velocities requires a significant magnitude of driving power and correspondingly large drive motors that are supported on the same structure as the mixing vessel. The principle behind high intensity mixing is to generate a large amount of energy in the product using an impeller, when, at the same time, the material is suspended and fluidized by the vortex created in the vessel. Sheared mixing and dispersed mixing take place while energy is exchanged between the mixing blades and the material, between the material and the vessel and between the material particles. Steam, oil and hot or cold water may be circulated through a vessel jacket to induce effective heating or cooling of the material during the mixing process.

Traditional designs for successfully serving these functions such as the Model VFM High Intensity Mixer by Reliance Industries of Stafford, Texas have been difficult to discharge the mixed product and extremely difficult to clean. In some cases, color contamination of less than 0.05% due to inadequate cleaning may waste an entire vessel batch. Consequently, each mixing unit may be unavailable for production for hours during a clean-up period although the actual mixing procedure requires only a few minutes.

Prior art machines designed for operating with simple, interchangeable vessels such as Model RC by Reliance Industries mounts the motor and drive assembly on a head plate that must be rotated to invert the vessel and deposit the mixture ingredients around the mixing blades. The entire pivoted mass, therefore includes not only the motor and drive assembly but also the mass of the vessel and material contents. While mixing is taking place, the consequential load and vibration is carried by bearings necessary to facilitate rotation of the assembly. The magnitude of applied power and mixing intensity is therefore limited.

SUMMARY OF THE INVENTION

An object of the present invention is provision of a material batch mixing system having a rapid recycling time. Relative to a rapid recycle, the invention provides greatly accessible internal structure for reduced cleaning time. A multiplicity of relatively inexpensive mixing vessels and mixing blades facilitates an option to clean mixing vessels and blades off-line between batch mixtures.

Another object of the invention is a batch mixing system that will substantially eliminate cross batch contamination due to inadequate cleaning of common mixing elements and structure and greatly reduces possibilities for resegregation of constituent ingredients.

A further object of the present invention is a high intensity batch mixing system having not only a high recycling rate but also adaptable to an unlimited magnitude of power source and delivery Also an object of the invention is an improved ratio of equipment capitalization versus product value enhancement. Corresponding with the improved equipment production value is reduce plant floor space devoted to material mixing.

It is also an object of the invention to provide a high intensity mixing machine of rugged construction and requires minimum repair and maintenance albeit is accessible for rapid and easy cleaning.

Another object of the invention is a mixing machine design having no limitation on the size of drive, magnitude of applied power number of transmission drive lines.

In service to these and other objects of the invention is a mixing apparatus in which batch quantities of material constituents to a mixture are combined in a portable vessel having a standardized form and size of top opening. Preferably, such a vessel is transportable to and from a connection position respective to a stationary power unit. The power unit comprises a closure structure that mates with the vessel top opening. Power actuated clamps secured to the closure structure are selectively operable to unitize the vessel with the closure structure.

Secured to the closure structure is a rotary mixing element having a substantially vertical mixing axis. Material agitation elements such as blades, paddles etc. are secured to the end of a driven spindle proximate of the closure structure inside face. The driven face of a rotary power coupling is secured to the outer end of the driven spindle.

Another characteristic of the closure is a power unit mounting structure that will selectively translate the closure vertically to and from a sealed engagement with a vessel top opening. The mounting structure is given sufficient capacity to lift the unitized vessel It and combined mixture ingredients from the vessel delivery support surface. Additionally, the closure mounting structure is rotatable about a laterally transverse axis. Such rotation of the mounting structure inverts the unitized vessel and axially aligns the rotary power coupling with a driving face. Reversed translation of the mounting structure brings the two faces of the rotary power coupling into operative engagement. Such inversion of the vessel deposits the mixture materials intimately upon and about the agitation elements.

The driving face of the rotary coupling is secured to the end of a driving spindle that is preferably driven by a sheave and belt transmission. A fixed position electric motor of substantially any size may be used to drive the belt transmission. The electric motor and belt transmission is secured within the same power unit as the closure mounting structure.

BRIEF DESCRIPTION OF THE DRAWINGS

For a thorough understanding of the present invention, reference is made to the following detailed description of the preferred embodiments, taken in conjunction with the accompanying drawings in which like elements have been given like reference characters throughout the several figures of the drawings.

DESCRIPTION OF THE PREFERRED EMBODIMENT

Figure 1:
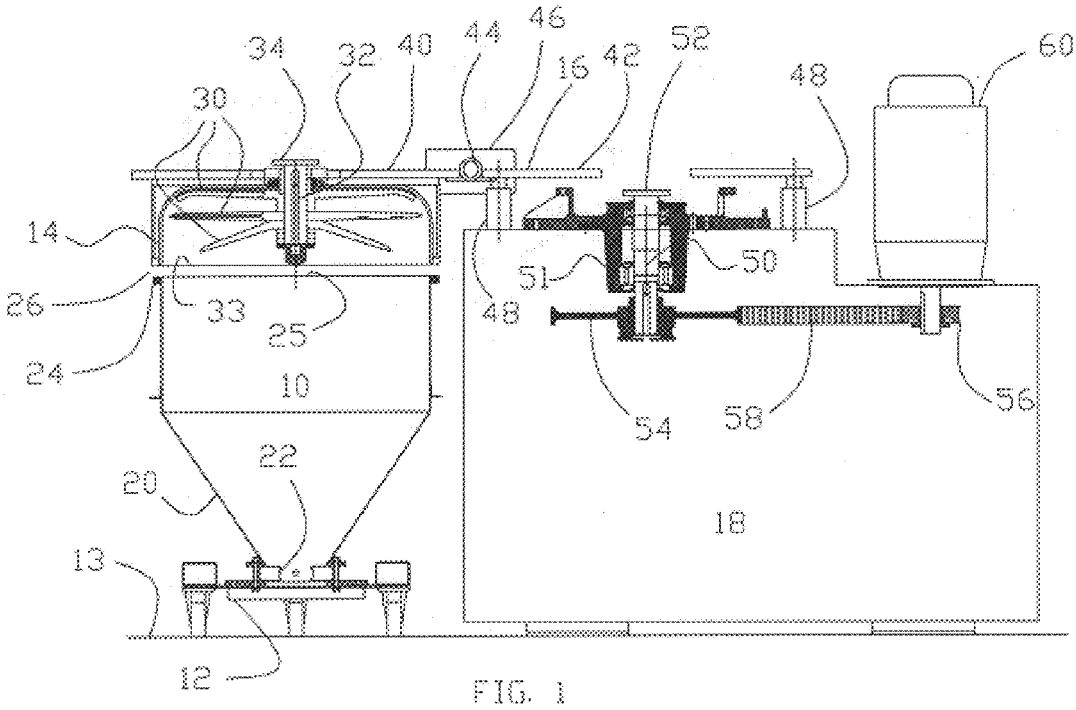
FIG. 1 is a schematic elevation showing the invention in partial section and the powered mixing head disengaged from the mixing vessel.
Figure 7:
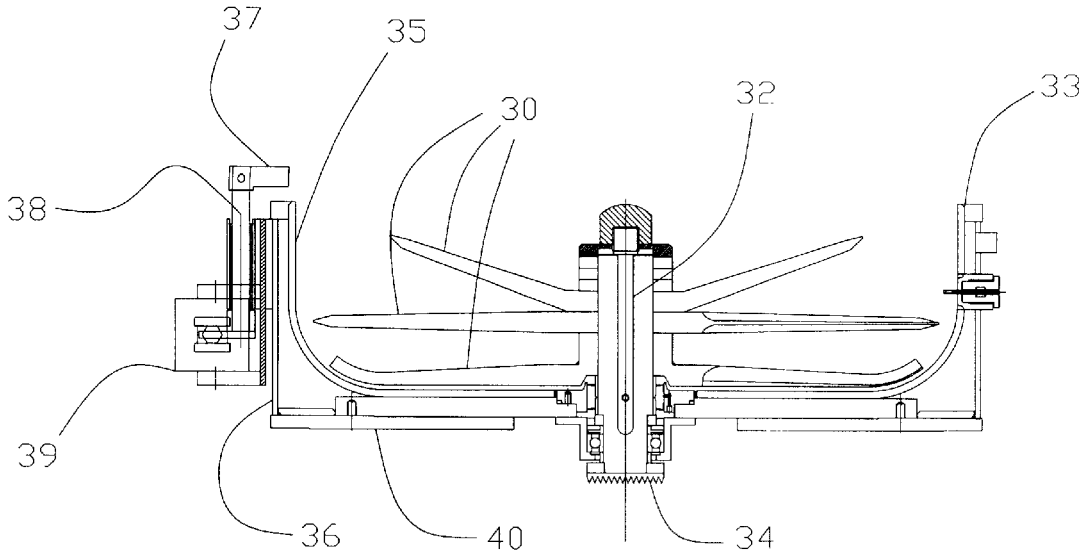
FIG. 7 is a schematic elevation showing one embodiment of the mixing head in partial section.
Figure 8:
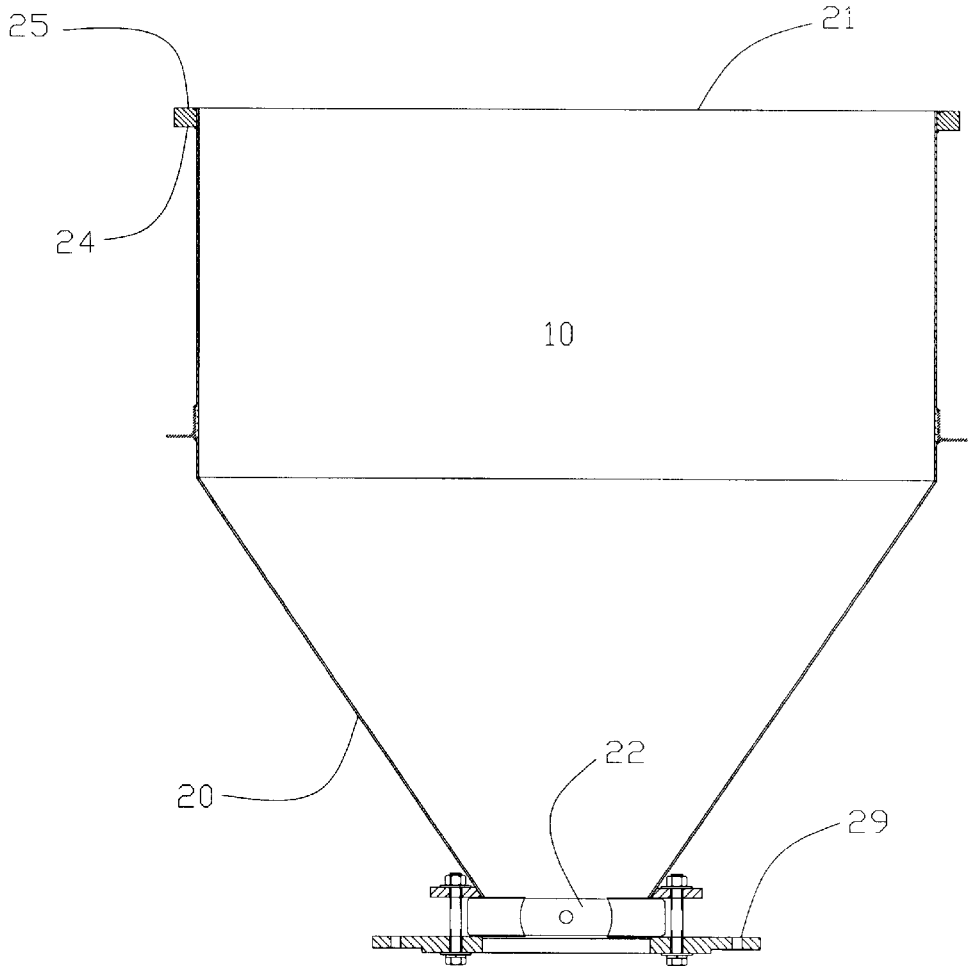
FIG. 8 is a schematic elevation showing the mixing vessel.

Referring to FIGS. 1, 7 and 8, in particular, the invention comprises a portable mixing vessel 10. Preferably, a plurality of mixing vessels 10 having substantially interchangeable dimensions are available. As a representative shape, the vessel 10 may include a funneled lower section 20 and a bottom discharge opening that is controlled by a butterfly valve 27. The vessel opening 21 through which mixture materials are loaded into the vessel is rimmed by a clamping lip 24. A base plate or flange 29 may support the vessel in an upright position for interface with a transport device.

This particular example of the invention relies upon a hand cart 12 for transport mobility of the vessel 10 from a prior station at which the vessel may be charged with mixture materials and to a subsequent station at which the completed mixture is discharged. It is also preferable to have a plurality of such hand carts available for transport of respective vessels as a progressive flow stream. The several hand carts 12 should have substantially uniform construction features and dimensions to provide a substantially uniform dimension between the floor 13 or other primary support surface and the vessel opening rim 25.

Those skilled in the art will understand that mixing vessels 10 may be of an infinite variety of shapes. A valved bottom discharge is an optional feature of the preferred combination. Although structural independence of the vessel 10 and hand cart 12 is preferred, there is no particular impediment to an integrated construction. Furthermore, the vessel 10 may be transported to and from the vessel closure assembly 14 by numerous other means such as a conveyor belt or an industrial fork-lift truck.

The vessel closure assembly 14 is shown in greatest detail by FIG. 7 to include an inner liner 35 supported by outer jacket 36. The jacket and liner assembly is secured to a closure mount swing plate 40. Optionally, the jacket/liner relationship may be constructed to circulate steam or chilled water depending on a desired heat environment for the mixing process. The swing plate 40 is pivotally attached to a translation plate 42 by means of a hinge 44. Rotation of the swing plate 40 about the axis of hinge 44 is controlled by a rack and pinion rotary drive 46. Vertical translation of the translation plate 42 and hence, the swing plate 40, driven by hydraulic translation struts 48.

Dynamic elements of the closure 14 include a driven spindle 32 that is rotatively confined by bearings. Along the length of the spindle 32 proximate of the closure seal lip 33 is a mixing blade assembly 30. To the outer end of the spindle 32 is a driven face coupling 34. Preferably, the coupling may be a self-aligning tooth coupling. Clearly, however, other coupling types such as magnetic couplings may be used. Around the closure jacket 36 are a plurality of rotating disc wedges 37 for engaging the underside of the vessel 10 clamp flange 24. The discs 37 are secured to clamp spindles 38. The clamp spindles are secured in respective journal bosses that are secured to the outer jacket 36. Linear actuators 39 acting through bellcranks attached to the clamp spindles 38 rotate the disc wedges 37 into a compressive engagement with the vessel clamp flange 24 to secure the vessel 10 to the closure 14 as a unit.

The power base 18 supports a suitable prime mover 60 such as an electric motor. The motor output shaft carries a belt drive sheave 56. Conveniently lateral of the motor 60, a spindle housing 51 is secured to an upper face of the power base housing. The housing 51 confines a rotary drive spindle 50 having opposite implement ends. The lower spindle 50 end carries a driven sheave 54 that is linked to the drive sheave by a cleated power belt 58.

Procedurally, the process aspect of the invention begins with charging the vessel 10, usually through the top opening. Those materials that are to be mixed or agitated are deposited into the vessel 10 through the opening circumscribed by the vessel rim 25. Such charging may occur at the mixing station adjacent to the power base or at a remote location. For purposes of the present description, it will be assumed that the mixture ingredients were charged into the vessel 10 at a remote location and that the charged vessel was carried on the hand cart 12 to the operational station illustrated by FIGS. 1–6.

Initially, the translation struts 48 are extended to lift the translation plate 42 to an upper limit. The swing plate 40 is folded out by the rack and pinion rotational drive 46 about the axis of hinge 44 to position the closure 14 above an alignment space for vessel 10. The upper limit of the translation plate 42 resultantly places the closure seal lip 33 above the vessel opening rim 25 by a prescribed clearance space 26.

Figure 2:
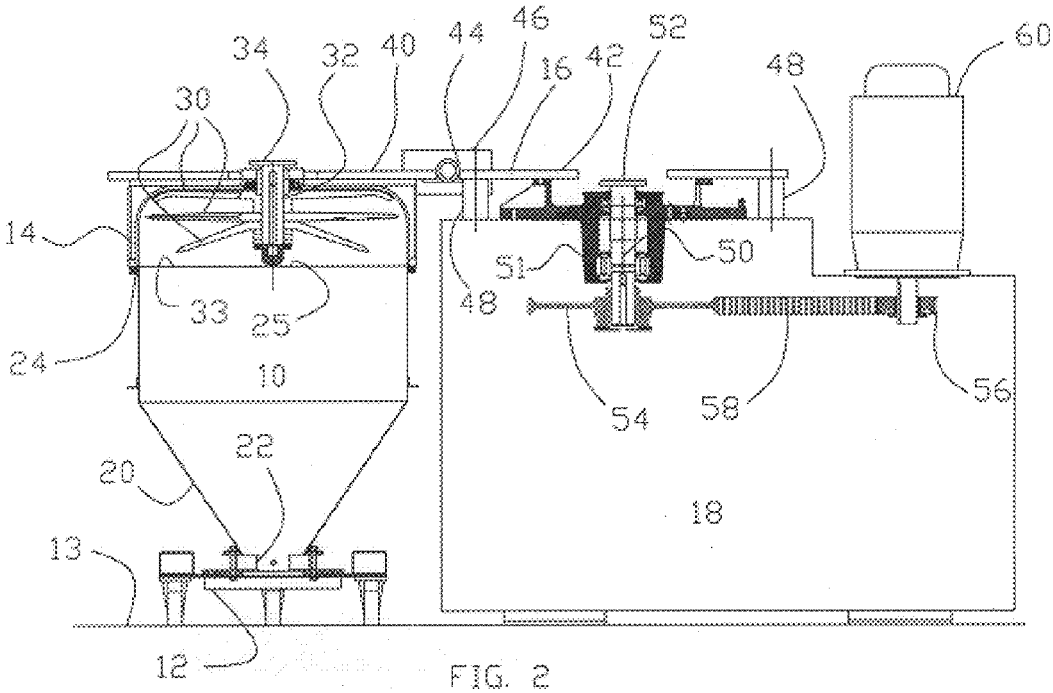
FIG. 2 is a schematic elevation showing the invention in partial section and the powered mixing head clamped and sealed to the mixing vessel.

With respect to FIG. 2 the translation struts 48 are retracted to lower the closure rim 33 physically against the vessel opening rim 25. Here, a plurality of clamp actuators 39 are engaged to rotate respective disc wedges 37 under the lower lip of the vessel clamp flange 24 thereby unitizing the vessel 10 with the closure assembly 14. Depending on the particular application for the invention, it may be desirable to engage fluid-tight seals between the closure rim 33 and the vessel rim 25. Reliance upon fluid tight seals usually requires, in addition, an internal volume vent for the volume confined within the closure 14 and vessel 10 unit.

Figure 3:
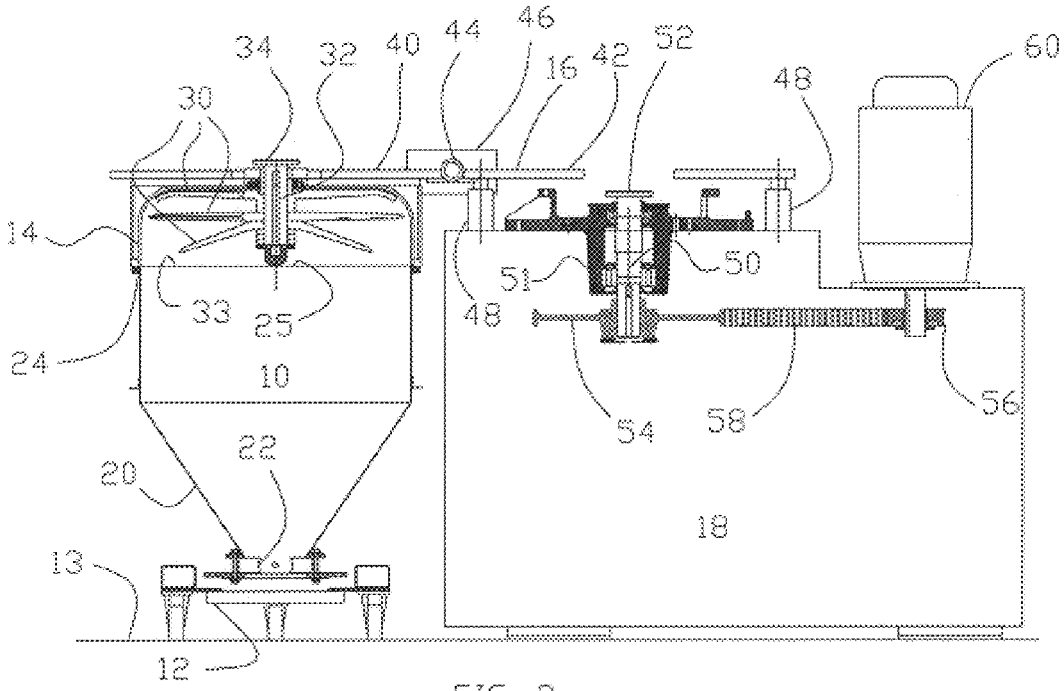
FIG. 3 is a schematic elevation showing the invention in partial section and the unitized mixing head and mixing vessel lifted for clearance above a portable platform.
Figure 4:
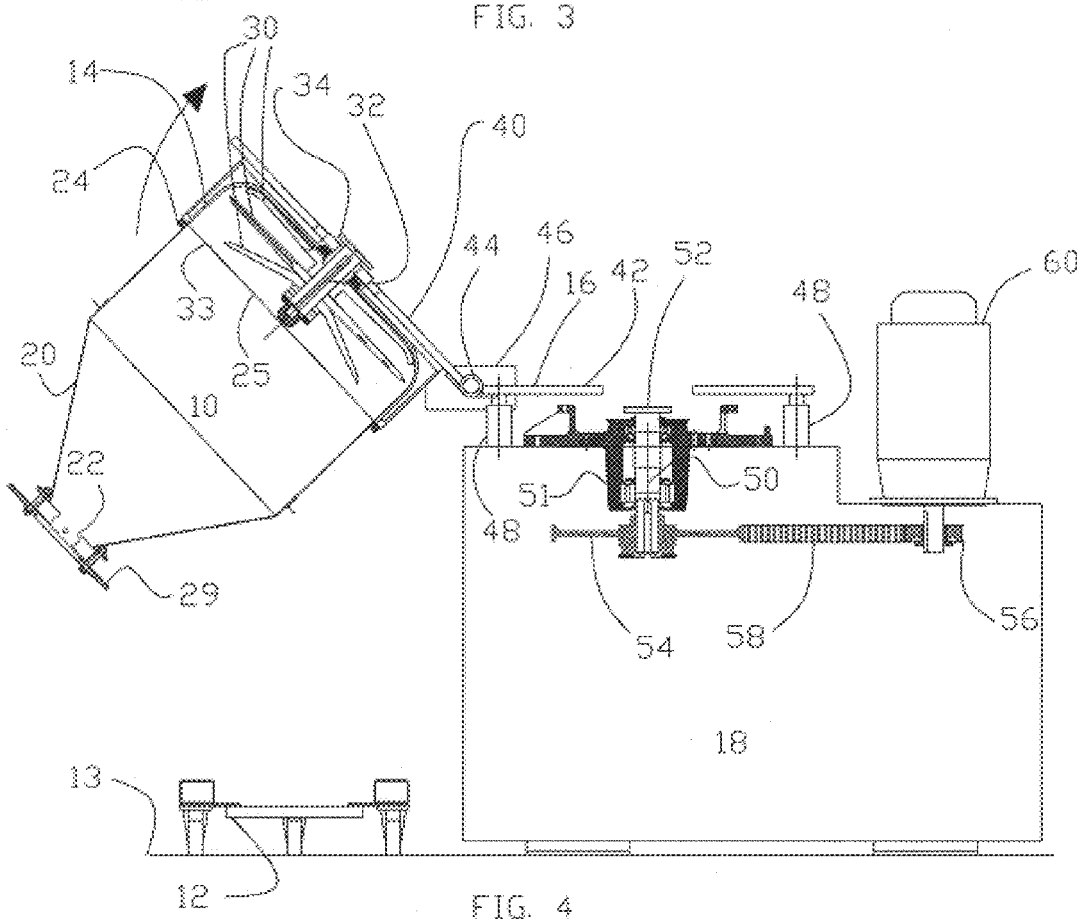
FIG. 4 is a schematic elevation showing the invention in partial section and the unitized mixing head and mixing vessel in rotation toward engagement with a powered drive unit
Figure 5:
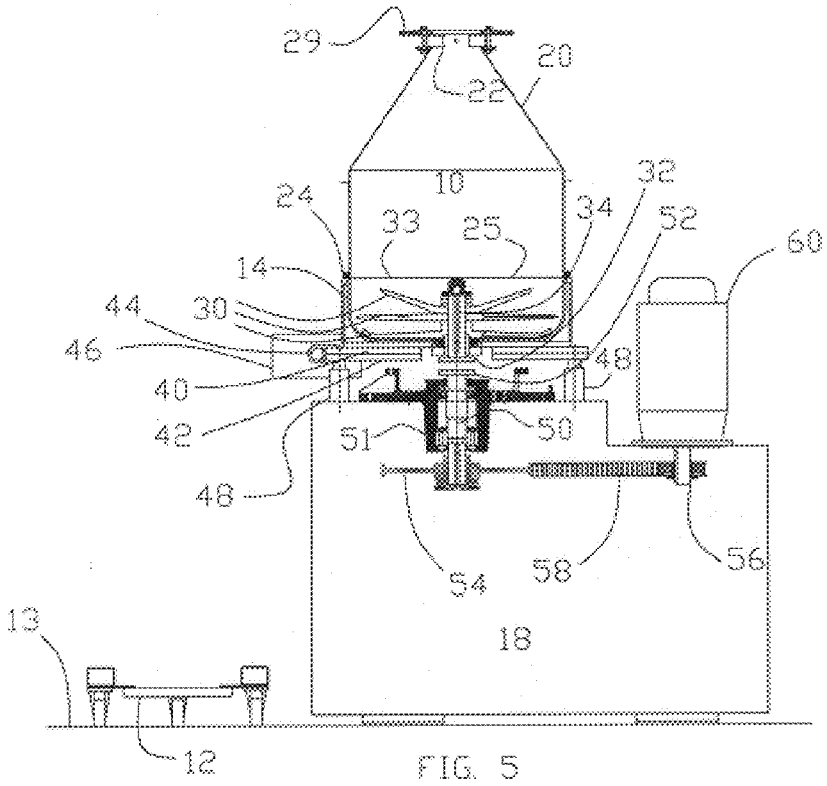
FIG. 5 is a schematic elevation showing the invention in partial section and the unitized mixing head and mixing vessel poised above engagement with a powered drive unit.
Figure 6:
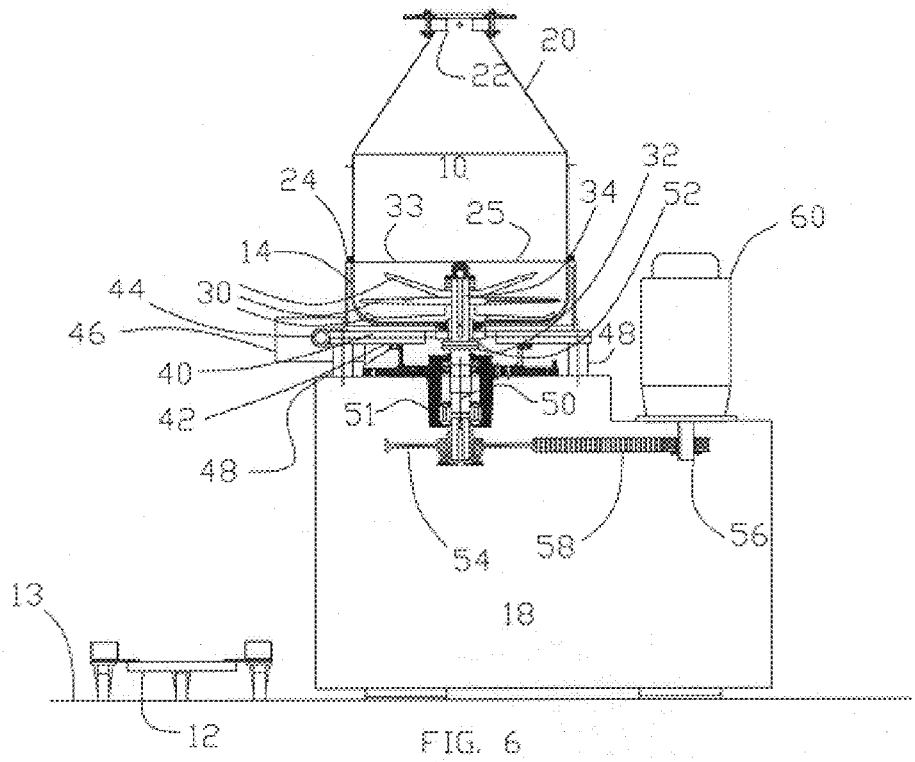
FIG. 6 is a schematic elevation showing the invention in partial section and the unitized mixing head and mixing vessel fully engaged with the powered drive unit.

FIG. 3 illustrates another extension of the translation struts 48 to lift the vessel base plate 29 above the structure of hand cart 12 by a clearance space 28 that is sufficient to permit rotation the vessel/closure unit about the axis of hinge 44. FIG. 4 shows the vessel/closure unit at an intermediate rotational position about the hinge 44 axis. As shown by FIG. 5, the vessel/closure unit rotation is complete with a contiguous lapping of the swing plate 40 against the translation plate 42. Here, the respective rotational axes of spindles 32 and 50 are coaxially aligned. However, the translation struts 48 are extended so the driving and driven coupling faces 52 and 34, respectively, are disengaged by a separation distance 49.

Finally, the translation struts 48 are again retracted to lower the driven coupling face 34 into torque transmitting engagement with the drive coupling face 52. Here, the rotational power of motor 60 is engaged to drive the mixing blades 30 through the material that has been transferred by gravity from the base volume 20 of the vessel 10 onto and around the mixing blades.

At the conclusion of the mixing interval, the foregoing sequence is reversed and the released vessel 10 is returned to the original hand cart 12 support position as shown by FIG. 1. The optional butterfly valve 22 is useful for a convenient gravity discharge of the mixed material from the vessel 10 into a below-floor receptacle not shown.

Figure 9:
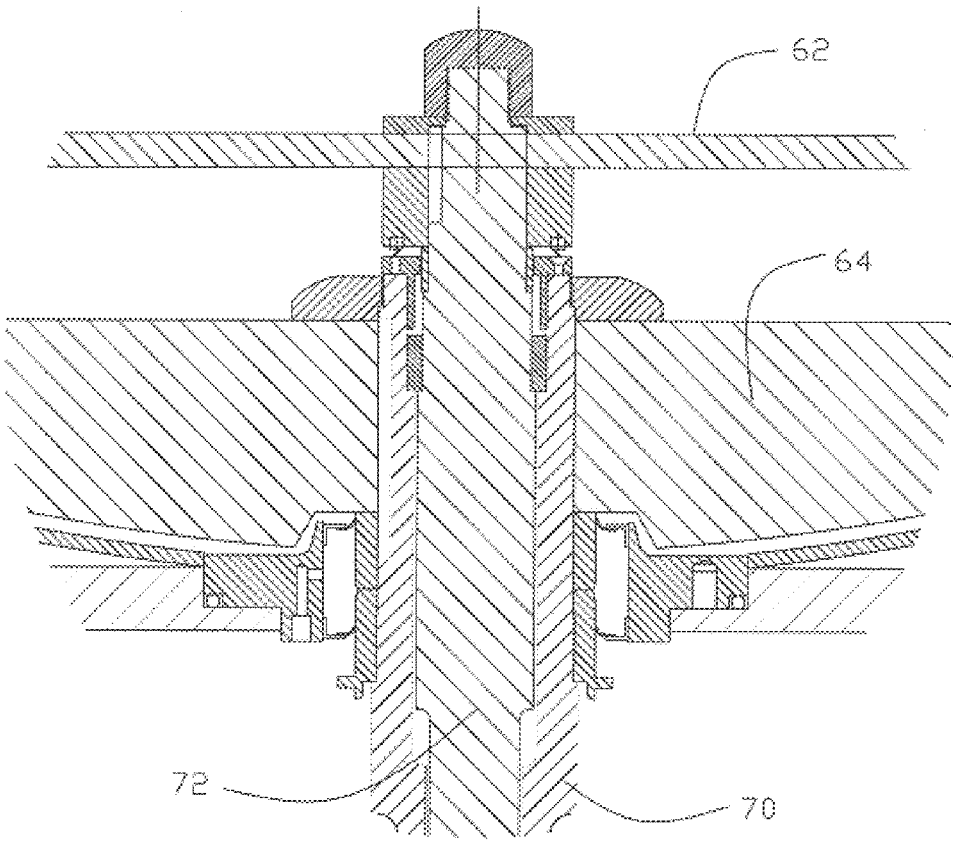
FIG. 9 is a detail showing a co-axial spindle and dual drive for each of independently driven mixing blades.
Figure 10:
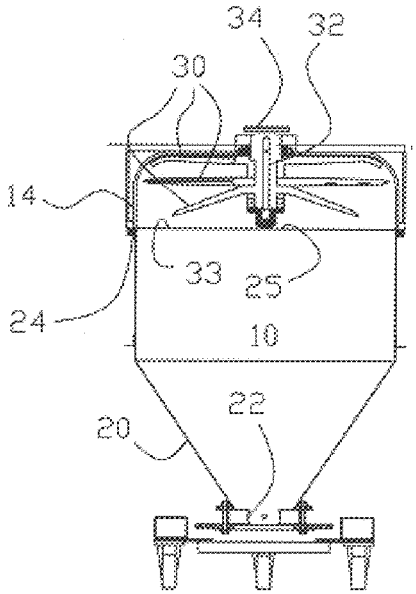
FIG. 10 is a schematic elevation showing the mixing head combined with the mixing vessel and disengaged from the powered drive unit for cleaning or storage.

In the alternative embodiment of the invention illustrated by FIG. 9, the mixer blade drive spindle comprises two or more coaxial spindles 70 and 72 respective to independent drive motors and trains. The outer drive spindle 70 is secured to the outer co-axial mixing blade 62 whereas the inner co-axial mixing blade 64 is secured to the inner drive spindle 72. Each spindle 70 and 72 may be driven by respective motors, transmissions and couplings. Consequently, each blade 62 and 64 may be driven at a respective speed and direction.

Although my invention has been described in terms of specified embodiments which are set forth in detail, it should be understood that the description is for illustration only and that the invention is not necessarily limited thereto, since alternative embodiments and operating techniques will become apparent to those of ordinary skill in the art in view of the disclosure. Accordingly, modifications are contemplated which can be made without departing from the spirit of the described invention.

What is claimed is:

1. A material mixing apparatus comprising:

(a) a mixing vessel end closure having material mixing structure secured thereto for rotation about a mixing axis, said mixing structure having a first rotational drive coupling secured thereto;

(b) a second rotational drive coupling for transferring rotary power about a substantially fixed axis to said first rotational drive coupling; and, (c) end closure support structure for translating said end closure substantially parallel with said fixed axis and rotating said end closure about an end closure inversion axis to engage said first rotational drive coupling with said second rotational drive coupling.

2. A material mixing apparatus as described by claim 1 wherein said mixing vessel end closure cooperates with a structurally independent mixing vessel to substantially seal an internal mixing volume.

3. A material mixing apparatus as described by claim 1 wherein said end closure is rotated about said inversion axis between first and second rotational positions.

4. A material mixing apparatus as described by claim 3 wherein said first rotational drive coupling is selectively translated between engagement and disengagement with said second rotational drive coupling when said end closure is positioned at said first rotational position.

5. A material mixing apparatus as described by claim 3 wherein said end closure is selectively translated between release and connection positions respective to said independent mixing vessel.

6. A material mixing apparatus as described by claim 5 wherein said end closure is rotated from said second rotational position to said first rotational position with said end closure secured to said mixing vessel.

7. A material mixing apparatus as described by claim 6 wherein said mixing structure comprises a blade that is secured to a first rotational drive shaft that is driven by said first rotational drive coupling for rotation about said mixing axis.

8. A material mixing apparatus as described by claim 6 wherein said mixing structure comprises at least a pair of blades that are secured to a respective pair of first rotational drive shafts, said pair of first rotational drive shafts being coaxially aligned and independently driven.

9. A material handling process comprising the steps of:

(a) depositing particulate materials in a portable vessel;

(b) translating vessel closure structure along a first axis onto said vessel, said closure structure including rotational mixing structure;

(c) securing said closure structure to said vessel as a unitized assembly;

(d) rotating said assembly to a substantially inverted vessel position;

(e) translating the inverted vessel assembly along said first axis to engage a rotary power transmission coupling with said rotational mixing structure; and, (f) rotatively driving said rotational mixing structure through said transmission coupling.

10. A material handling process as described by claim 9 wherein said particulate materials are deposited into said vessel at a location removed from said vessel closure structure.

11. A material handling process as described by claim 9 wherein said first axis is substantially coincided with a second axis respective to said rotary power transmission coupling at said inverted vessel position.

12. A material handling process as described by claim 9 wherein said rotational mixing structure comprises a pair of blades that are rotated independently about a coaxial axis.

13. A particulate material mixing procedure comprising the steps of:

(a) combining materials including a particulate through an opening in a portable vessel;

(b) closing said vessel opening with a cover;

(c) providing material mixing structure secured to said cover for rotation about a first axis;

(d) securing said cover to said vessel as a unitized assembly;

(e) rotating said unitized assembly about a second axis to a substantially inverted vessel position;

(f) translating a rotatory power transmission coupling along said first axis into engagement with said mixing structure at said inverted position; and, (g) rotatively driving said mixing structure through the combined materials.

14. A particulate material mixing procedure as described by claim 13 wherein rotational driving force for said mixing structure is provided about a third rotational axis, said rotation of said unitized assembly about said second axis positions said first rotational axis substantially coaxially with said third rotational axis.

15. A particulate material mixing procedure as described by claim 14 wherein mixed material is removed from said vessel by the sequence including the steps of (a) translating said unitized assembly along said coaxial first and second axes to disengage said rotary power transmission coupling from said mixing structure;

(b) rotating said unitized assembly about said second axis to a substantially erect position;

(c) translating said unitized assembly onto a support platform; and, (d) releasing said cover from said vessel.

* * * * *